United States Patent [19]

Baumgartner

[11] 4,422,772

[45] Dec. 27, 1983

[54] MIXING APPARATUS

[75] Inventor: Rolf Baumgartner, Oftringen, Switzerland

[73] Assignee: Rolf Baumgartner AG, Switzerland

[21] Appl. No.: 290,868

[22] Filed: Aug. 7, 1981

Related U.S. Application Data

[63] Continuation-in-part of Ser. No. 103,495, Dec. 14, 1979, abandoned.

[30] Foreign Application Priority Data

Dec. 22, 1978 [CH] Switzerland ..... 13070/78

[51] Int. Cl.[3] ..... B01F 7/14

[52] U.S. Cl. ..... 366/287; 366/331

[58] Field of Search ..... 366/222, 223, 224, 247, 366/249, 250, 251, 252, 287, 288, 331, 244; 222/404; 414/306, 319; 277/67, 68, 69, 105

[56] References Cited

U.S. PATENT DOCUMENTS

| | | | |
|---|---|---|---|
| 1,962,380 | 6/1934 | Biggs | 277/67 |
| 2,831,663 | 4/1958 | Nauta | 366/287 |
| 2,858,196 | 10/1958 | Ballard et al. | 366/247 |
| 3,322,403 | 5/1967 | Murphy | 366/247 |
| 3,894,741 | 7/1975 | McHugh | 277/67 |
| 3,937,444 | 2/1976 | Kapp | 366/244 |
| 4,057,226 | 11/1977 | de Mos et al. | 366/244 |

*Primary Examiner*—Robert W. Jenkins
*Assistant Examiner*—Arthur D. Dahlberg
*Attorney, Agent, or Firm*—McGlew & Tuttle

[57] ABSTRACT

A worm mixer is disclosed in which a cover is mounted to a substantially conically shaped vessel with a vertical axis defining a chamber for the mixing of materials. The cover is mounted on the vessel so as to allow rotation of the cover and vessel relative to each other. An elongated mixing worm is mounted to the cover at an off center location and extends within the chamber. The drive while rotating the worm about its axis is connected to an upper end of the worm which extends through the cover. The lead through of the worm through the cover is sealed and at least one bearing is provided rotatably journalling the worm about its axis near the upper end of the worm. The worm bearing and drive means are mounted exclusively outside of the chamber.

15 Claims, 6 Drawing Figures

Fig. 4
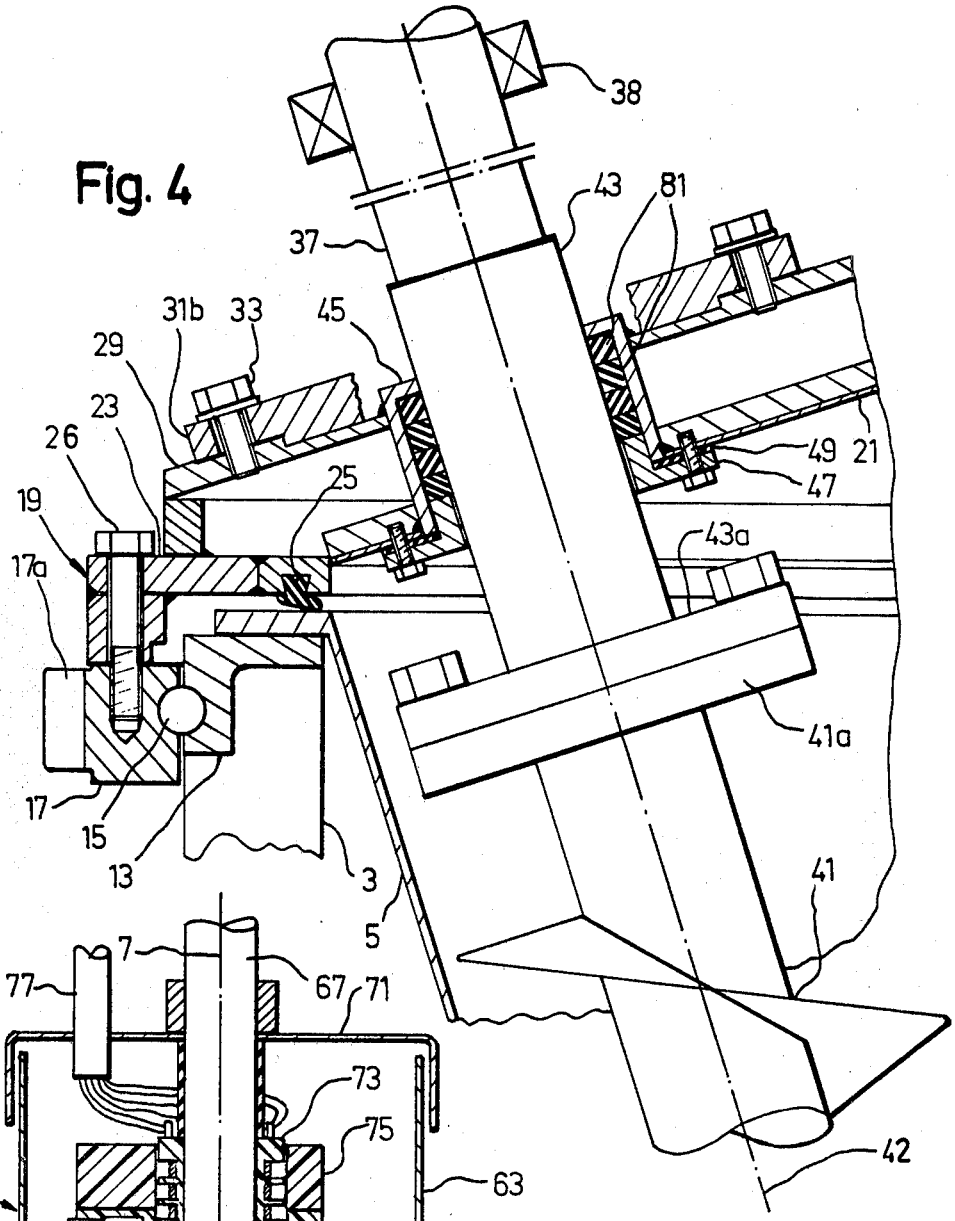
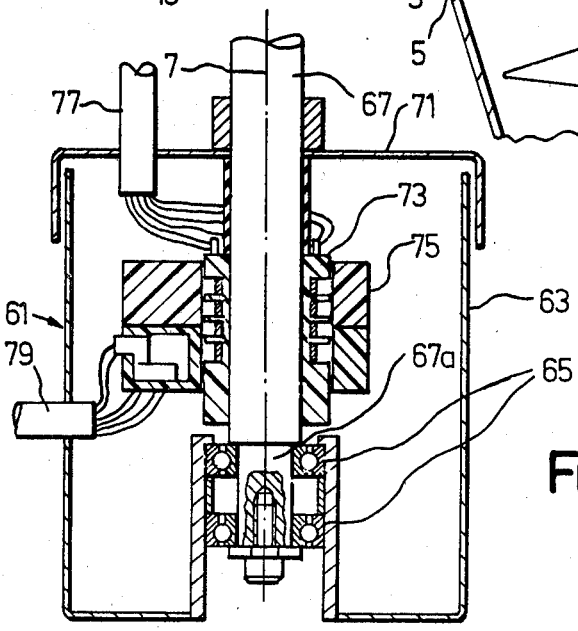
Fig. 5

MIXING APPARATUS

The present application is a continuation-in-part of U.S. patent application Ser. No. 103,495, filed Dec. 14, 1979 and now abandoned, the subject matter of which is incorporated herein by reference.

BACKGROUND OF THE INVENTION

The present invention relates to a mixing apparatus.

In a known mixing apparatus, the upper end of the inclined worm is rotatably journalled on the arm of a crank which, in turn, is rotatably journalled in the center of a cover of a conical vessel. In operation of the apparatus, the crank is turned through the center of the cover so that the worm moves along the conical vessel wall. In order to turn the worm about its axis, one of two different drive devices is employed according to the density of the bulk material to be mixed. For the mixing of mixture materials, the density of which is relatively small and is, for example, below 0.7 kilograms per liter, the worm is driven through a Cardan joint arranged at the lower convergent end of the conical vessel. In an apparatus for the mixing of mixture materials, the density of which is greater than 0.7 kilograms per liter, the drive of the worm takes place from above through the interior of the crank.

Both apparatuses have different disadvantages. A disadvantage, which is common to both apparatuses is that the crank, a bearing serving for its journalling and a gear required for its drive are relatively expensive and appreciably increase the manufacturing costs. In order to move the worm along the vessel wall through the mixture stock, in accordance with the properties thereof, very great forces are required in some circumstances. The crank and the bearing serving for its journalling must therefore be very robustly constructed. Since the crank, in the center of the cover, is driven through a shaft and the worm is journalled at the free end of a crank arm forming a long lever arm, great turning moments must be transmitted through the shaft of the crank. The gear, which connects a driving motor to the shaft of the crank, must correspondingly result in a very large step-down ratio and is therefore expensive.

In those apparatuses, in which the drive of the worm takes place through a Cardan joint at the lower vessel end, the joint must constrainedly be arranged on the axis of the vessel. Accordingly, the withdrawal of mixed stock, which likewise takes place at the lower end of the vessel, is made more difficult. The mixed stock can then not be conducted perpendicularly downwards out of the vessel in the center of the lower vessel end, but must be conducted laterally around the Cardan joint. A further disadvantage is that the cardan joint is relatively expensive and moreover liable to trouble, because it has parts contacting the bulk material to be mixed. Furthermore, a shaft feedthrough closing off the interior space of the vessel tightly is required with the Cardan joint.

In those apparatuses in which the drive for the rotation of the worm around its axis takes place through the crank, a shaft must be disposed in the hollow shaft of the crank as well as in the arm of the crank. Both these shafts must be connected to one another through a bevel gear. Furthermore, a bevel gear, which connects the shaft contained in the crank arm with the worm, is however also necessary at the free end of the crank arm. The drive through the crank is thus very complicated and expensive. Moreover, another substantial disadvantage is that the bearing of the worm at the free end of the crank arm, and the bearing of the shafts extending through the crank shaft and the crank arm, as well as the bevel gears generally, require a lubrication. The lubrication points must, however, be sealed off from the free interior space of the mixing vessel because the apparatus is frequently used in chemical processes for the mixing of materials which may not be contaminated by a lubricant. To seal off the lubrication points of the crank, different seals are required, which complicate the construction of the crank still further. In addition, the maintenance, by which the crank must be cleaned and occasionally disassembled, is very time-consuming. A further disadvantage of known apparatuses is that, although the worm is driven through the crank, it is necessary in many cases to journal the worm at its lower end in a ball-and-socket joint. The crank can, in many cases, not be designed to be so rigid and robust and journalled that is suffices to journal the worm at only one end at the crank arm.

German utility model spacification No. 7 420 361, which corresponds to U.S. Pat. No. 3,937,444 discloses a conical mixing apparatus in which the central part of the upper opening of the conical vessel is covered over by a rotatable cover. This is in operating turned by a motor with a spur wheel gear. The lower end of the worm is journalled at the lower end of the vessel by a pivotable ball. The upper end of the worm is connected in the interior of the conical vessel through an articulated connection with a vertical rotatable shaft. The shaft in its turn belongs to a drive unit with a spur wheel gear which itself altogether is rotatable and arranged underneath the cover eccentrically in the interior of the vessel. The drive is connected through a hollow shaft which is conducted through the rotatable cover, and an inner shaft arranged in this with a gear, which is arranged on the outside of the cover and which in operation is driven by the rotary motion of the cover and drives the worm so that this is turned around its own axis and additionally circulates around the mentioned hollow shaft and internal shaft.

With this known apparatus, mixture stock can be filled only into the lower half of the conical vessel or, at best, up to nearly the end of the worm. The space disposed thereover must remain free for the drive unit. As a result, the known apparatus has appreciable overall heights. This in turn acts unfavorably on the manufacturing costs. Furthermore, an apparatus of that kind cannot be used at all in many fields in which high degrees of purity matter. Thus, contact of the substances to be processed with gear parts or the like requiring lubrication is impermissible in the chemical, pharmaceutical or the foodstuffs industries. Furthermore, cleaning of the vessel and the drive unit disposed therein requires a great labor effort. In addition, it would, in that apparatus, be possible only with very great effort to seal off the conical vessel outwardly in gas-tight manner as may be necessary or expedient for certain applications. Further disadvantages also result from the fact that the worm is and must be journalled at the lower end. This journalling can likewise cause contamination of the mixture stock, make the cleaning of the mixer still more expensive and reduces the free cross-sectional area of the outlet during the emptying of the vessel. Furthermore, the complicated gears appreciably increase the manufacturing and maintenance costs.

SUMMARY OF THE INVENTION

An object of the present invention is to provide a mixing apparatus by which the disadvantages of the known apparatuses can be explained. The apparatus particularly in economical manner makes it possible to mix mixture stock, on the purity of which high demands are made.

According to the present invention there is provided a mixing apparatus comprising wall means of conical configuration defining a vessel having a divergent end and a convergent end spaced axially of said vessel from said divergent end, a cover member adapted to close said divergent end of said vessel, first drive means comprising drive elements operable to cause relative driving rotation between said vessel and said cover member when said cover member closes said vessel, elongate worm means extending within said vessel, a drivable member of said elongate worm means extending through said cover member, and second drive means comprising drive elements operable to rotate said worm means axially thereof, wherein said worm means extends internally of said vessel eccentrically of the axis of said vessel and said second drive means is disposed externally of said vessel and connected externally of said vessel to said drivable member.

In accordance with a preferred embodiment of the invention, a worm mixer is provided having a substantially conically shaped vessel with a vertical axis defining a chamber for mixing of materials, a cover mounted on the vessel allowing rotation of the cover and the vessel relative to each other about the vertical axis of the vessel, elongated worm means mounted to the cover at an off center location and extending within the chamber, drive means for rotating the worm means about its axis, the worm means having an upper end extending through the cover, sealing means sealing lead-through of the worm means through the cover, at least one bearing for rotatably journalling the worm means about its axis near the upper end of the worm means outside of the vessel and wherein the bearing is mounted on the outside of the sealing means and wherein the drive means is arranged and connected with the worm means on the outside of the sealing means. In accordance with the invention, the interior of the vessel is free of any gear and motor serving to drive the worm means and the worm means is journalled at its upper end exclusively outside of the vessel.

Thus, in accordance with the invention, a worm mixer is provided which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

An embodiment of the present invention will now be more particularly described by way of example and with reference to the accompanying drawings in which:

FIG. 4 shows a detail from FIG. 1 to enlarged scale;

FIG. 5 shows a vertical section through an electrical slip-ring device; and

DETAILED DESCRIPTION

Figure 1:
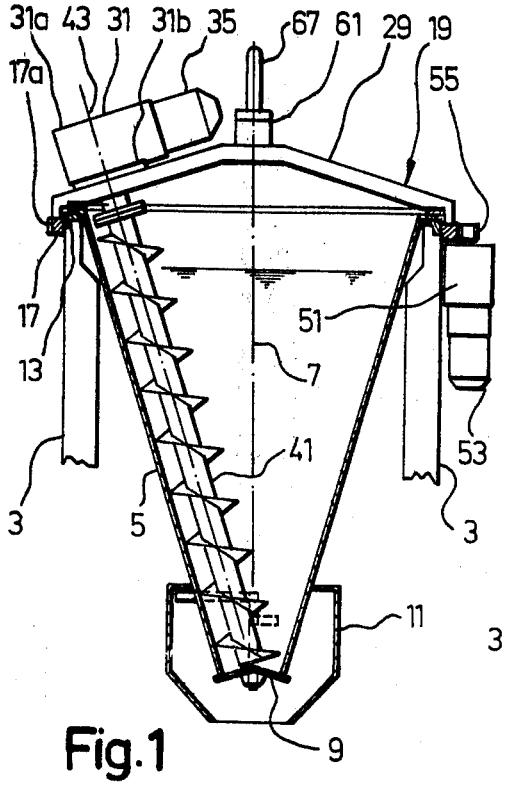
FIG. 1 shows a vertical section through a mixing apparatus, according to the invention, in which a yoke, a gear and motors are not illustrated in section.

The drawings show a mixing apparatus comprising a frame 1 with columns 3. Fastened to the upper ends of the columns 3 is a conically shaped mixing vessel 5, the wall of which is rotationally symmetrical in respect of a vertical axis 7 and narrows conically downward to define a conical chamber for the mixing of materials added thereto. The vessel 5 is provided at its lower end with an outlet opening which is tightly closed by a base member 9 which is foldable away. A hood 11 is arranged at the lower region of the vessel.

Figure 3:
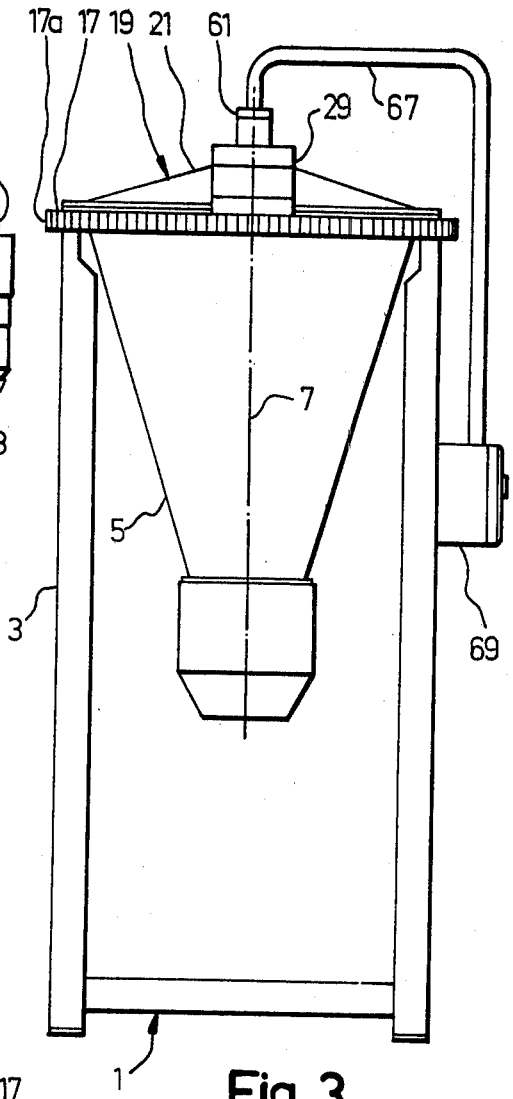
FIG. 3 shows a side elevation of the apparatus.
Figure 2:
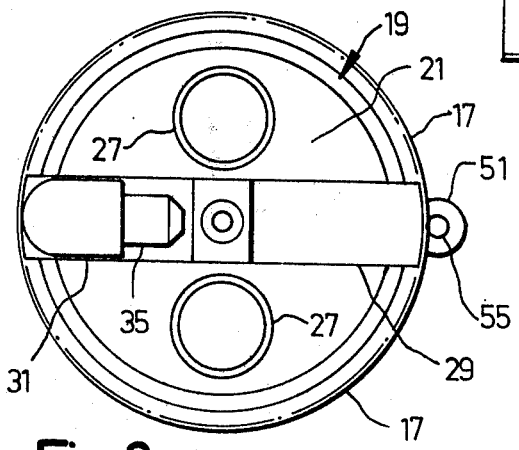
FIG. 2 shows a plan view of the apparatus shown in FIG. 1.

A bearing ring 13 (FIG. 4) is arranged coaxially with the axis 7 at the upper rim of the vessel 5 and is connected rigidly with the upper rim and the columns 3. A ring 17, which at its circumferential surface is provided with a gear rim 17*a*, is rotatably journalled by means of balls 15 externally of the bearing ring 13. A cover 19, which comprises a sheet metal hood 21 and ring 23 forming its rim, is arranged over the vessel 5. The outer part of the hood 21 forms an upwardly narrowing cone, the half conical angle of which is equal to the difference between a right angle and the half conical angle of the conical wall of the vessel 5. Consequently, lines of the vessel wall and of the hood 21 extending in the same vertical plane together form a right angle. The ring 23 is detachably fastened by means of screws 26 at the rotatably journalled ring 17. The cover 19 is thus rotatable around the axis 7 and fixedly connected, rotationally fast, to the gear rim 17*a*. The ring 23 is provided at the bottom with a dovetail groove, into which a resilient rubber sealing ring 25 is inserted, which comprises a lip bearing against the upper rim surface, extending radially to the axis 7, of the vessel 5. The cover 19 is provided with two openings which in their turn are closed off tightly by detachably fastened covers 27 and serve as viewing windows as well as for the filling-in of the mixture stock. Between both the covers 27 is a yoke 29, which comprises two limbs that have the same inclination as the envelope lines of the conical part of the hood 21. A gear 31 with a housing 31*a* and a base 31*b* is fastened to the yoke 29 in the proximity of the rim of the cover 19. As is evident from the FIG. 4, in which only the base 31*b*, a driven shaft 37 and a schematic bearing 31 are illustrated, the gear is fixedly screw fastened to the yoke 29 by means of screws 33. The drive shaft 37, which is rotatably and axially non-displaceably journalled in the gear housing 31*a* by means of the schematically illustrated bearings and possibly further bearings, extends at right angles to the yoke limb, which it penetrates, in parallel to the next adjacent envelope line of the conical wall of the vessel 5. The gear 31 is constructed as bevel gear (not shown) and its drive shaft (also not shown) extends at right angles to the drive shaft 37 along a vertical plane extending through the axis 7. The housing of an electrical motor 35, the shaft of which is connected with the drive shaft of the gear 31, is furthermore rigidly fastened to the gear housing 31*a*. The gear 31 and the motor 35 are omitted in FIG. 3 for clarity.

A mixer worm 41, arranged in the vessel 5, is disposed eccentrically and inclined with respect to the symmetry axis 7 of the vessel so that its rotational axis 42 extends parallel to that envelope line of the conical vessel wall which is just next to it. The worm 41 is provided at its upper end with a flange 41*a*. This is screwed rotationally fast to a flange 43*a* of a coupling piece 43, which penetrates an opening of the hood 21 and of the yoke 29, and is connected rotationally fast and axially non-displaceably at the drive shaft 37 of the gear 31. The opening in the hood 21 and the yoke 29 has a diameter which is greater than the external diameter of the cylindrical part of the coupling piece 43 penetrating it. Inserted in the opening is a bushing which comprises a sleeve 45 welded to the yoke and a flange 47 which is screwed fast onto the inside of the hood 21. A sealing ring 49 is arranged between the flange 47 and the hood 21. The flange 47 is provided with an annular section protruding into the sleeve 45 and the sleeve at its end remote from the flange is provided with a constriction. Arranged between the constriction and the flange 47 are sealing rings 81, the internal surfaces of which bear against the coupling piece 43.

The lid 19 is thus sealed along its rim by the sealing ring 25. Furthermore, the sleeves 45, the flange 47 and the sealing rings 49 and 81 close off the internal space of the vessel 5 tightly from the outside when feeding the coupling piece 43 through the cover 19.

As already mentioned, the drive shaft 37 of the gear 31 is rotatably and axially non-displaceably journalled in the housing 31*a* by means of at least one bearing 38. This bearing or these bearings are thus disposed on the outside of vessel 5 beyond the cover 19 and the sealed-off feedthrough of the worm 41 or of the coupling piece 43. The bearing is designed so as to absorb all the forces acting on the worm 41 in operation so that no further bearings are required for journalling the worm. As is evident from FIG. 1, in particular, the lower end of the worm is completely free, i.e. it is not journalled. The housing 31*a* of the gear 31 is sealed so that lubricant cannot get out of the housing.

Fastened to one of the columns 3 is a gear 51, to which an electrical motor 53 is fastened. The motor has a shaft connected with the drive shaft of the gear. A pinion 55, which meshes with the gear rim 17*a*, sits rotationally fast on a vertically extending output shaft of the gear.

An electrical slip-ring device 61 (FIG. 5) is arranged at the center of the yoke 29, i.e., aligned with the axis 7. The slip-ring device 61 at its lower end comprises a circularly cylindrical housing 63. This is held by mounting means (not shown) so as to be fixedly supported by the yoke 29. The housing 63 is journalled, by means of ball-bearings 65, so as to be rotatable on a vertical end section 67*a*, coaxial with the axis 7, of a rod 67. The rod 67 is bent away above the slip-ring device 61 and is connected with a switch box 69 that is fastened to the frame 1. A cover 71, having a rim which encloses the upper rim of the housing 63 with some play, is fastened to the rod 67. In the interior of the housing 63, a collector 73 with a carrier ring of insulating material and four electrically conducting slip-rings is arranged rotationally fast on the vertical section of the rod 67. Fastened to the housing 63 is a current pickup 75, which comprises insulating bodies and wiping contacts resiliently held by this, each of which contacts one of the slip-rings. The collector 73 comprises terminals which are connected through a cable 77 with the switch box 69. The wiping contacts of the current pickup 75 are connected through a cable 79 with the motor 35.

When a mixture stock of, for example, a bulk material is to be mixed by the conical worm mixer, this mixture stock is introduced through one of the covers 27 into the chamber of the vessel 5 and the cover is thereafter tightly closed. For mixing, the cover 19 is rotated around the axis 7 by means of the motor 53 by way of the gear 51 and the pinion 55 meshing with the gear rim 17*a* so that the worm is moved along the wall of the vessel 5. Furthermore, current is also fed to the motor 35 through the slip-ring device 61 and the worm 41 is turned around its axis 42.

The rotational speed of the worm is about 50 to 150 revolutions per minute. The rotational speed of the cover 19 is less and for example amounts to 1 to 5 revolutions per minute. Since the gear rim 17*a* has a diameter, which is for example 10 to 20 times greater than that of the pinion 55, the pinion 55 and the gear rim 17*a* result in a large reduction. The gear 51 produces a relatively small reduction.

When the mixing process is concluded, the motors 35 and 53 are switched off. Thereafter, the base member 9 of the bottom is opened, and the mixture stock is discharged from the vessel 5 and transferred into, for example, a transport container.

Since all bearings and gears are disposed externally of the interior space of the vessel bounded by the vessel 5 and the cover 19, lubricants cannot get into the vessel 5. Furthermore, the vessel 5 and the parts disposed therein are readily accessible for easy cleaning. The conical worm mixer can be used for mixing goods for which the highest demands of purity are set.

Granular bulk materials as well as viscous goods can be mixed. Furthermore, an excess pressure or an underpressure can readily be present in the vessel 5 during the mixing operation. The sealing ring 25 comprises a lip which is inclined away from the ring 23 downwardly and towards the interior of the vessel 5. When excess pressure prevails in the interior space of the vessel, the sealing lip is therefore additionally urged against the vessel rim. The sealing ring 25 is thus particularly well suited for mixing processes in which either an excess pressure or ambient pressure arises in the interior space of the vessel. When the conical worm mixer is used in mixing processes in which an underpressure is present in the interior space of the vessel, a sealing ring, comprising a lip inclined downwardly and outwards, can be employed in place of the sealing ring 25.

The conical worm mixer can be modified in other respects. For example, the non-rotating part of the electrical slip-ring devices 61 could be fixedly connected, instead of through the rod 67 with the frame 1, to the cover of the space in which the conical worm mixer is erected. Furthermore, the bushing for sealing the coupling piece 43 could be reversely arranged so that the screws are accessible from the outside of the lid.

Furthermore, the motor, which is fastened to the cover and serves for the drive of the worm and in operation rotates with the cover, could be replaced by a motor which is fastened to the frame. This motor and the worm could then be connected with each other through a gear which could possibly comprise a chain wheel journalled fast in the frame and a chain wheel connected with this through a chain and journalled in the rotational axis of the cover on this.

Furthermore, it would be possible to fasten the cover nonrotatably on the frame of the apparatus and for this to journal the conical vessel rotatably and to turn it relative to the cover around a common axis of symmetry.

Furthermore, it would be possible to enlarge the diameter of the slip-ring device and for the filling-in of the mixture stocks to provide in the center of the cover a passage penetrating the slip-ring device. This would have the advantage that the entry opening for the mixture stocks is disposed at the same position for each rotational position of the cover.

Figure 6:
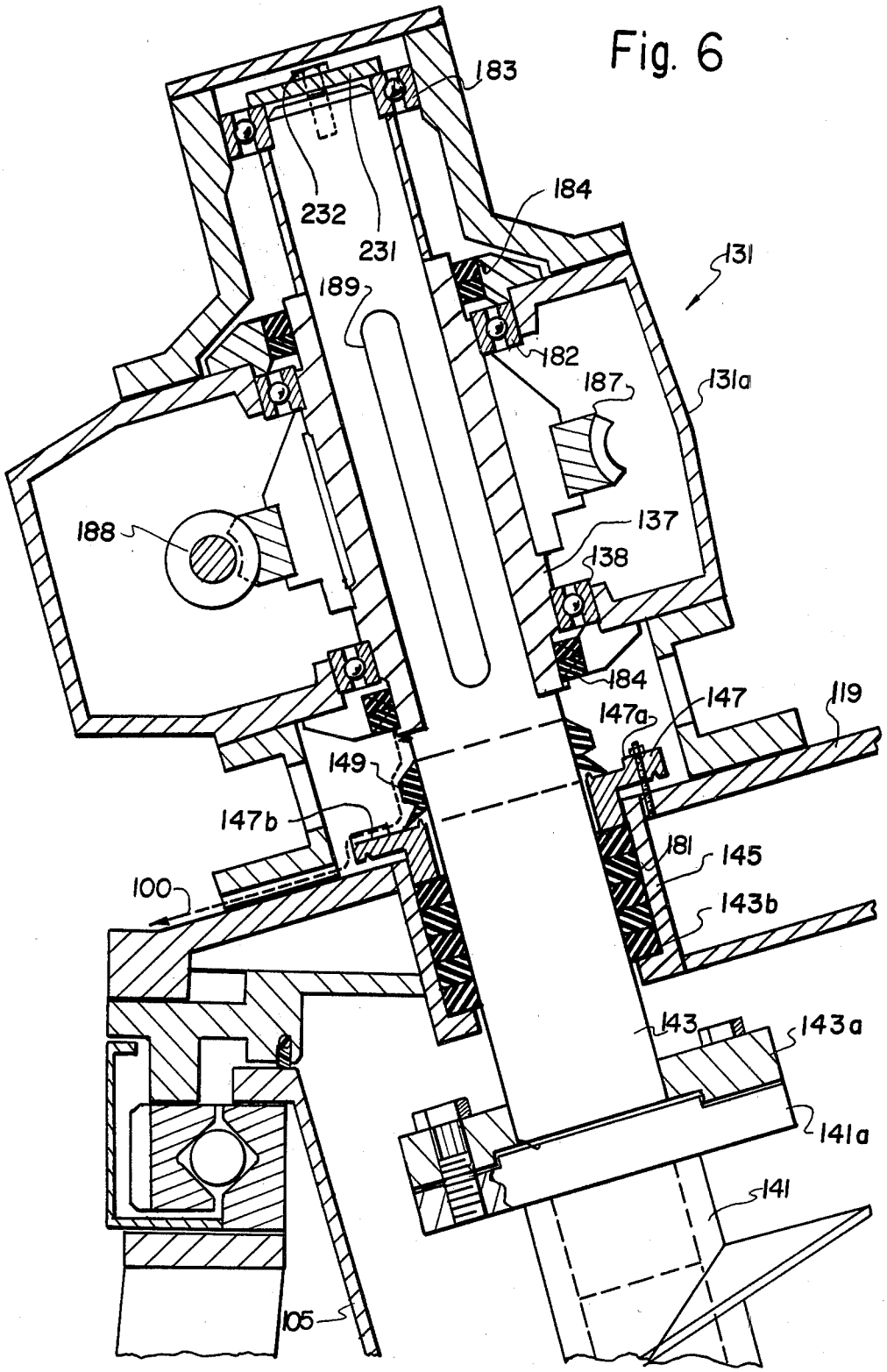
FIG. 6 shows a section through a gear housing illustrating the manner in which the worm is journalled and sealed.

FIG. 6 illustrates a more detailed and slightly modified version of the leadthrough and journalling of the worm means. A housing 131*a* of a gear 131 is rigidly and detachably fixed to the cover 119 on the outside of the latter. The worm means comprise a worm 141 substantially identical with the worm 41 and completely arranged inside the mixing chamber limited by the conical vessel 105 and the cover 119. The worm 141 comprises a cylindrical core, at least one rib extending along the core in the form of a helix and a flange 141*a*. A connecting or coupling piece 143 comprises a flange 143*a* fixed rigidly and detachably to the flange 141*a* by screws. The coupling piece 143 further comprises a full shaft 143*b* extending outside the mixing chamber through a leadthrough provided in the cover 119. This leadthrough is formed by a stuffing box comprising a sleeve 145 welded or otherwise fixed rigidly to the cover 119, a pressing member 147 and a sealing package formed by at least one and preferably two or more sealing rings 181. The pressing member 147 comprises a flange placed on the upper side of the cover and fixed thereto by bolts. The flange is provided with an upwards protruding rim portion 147*a* having a radial groove 147*b* at its lowest part.

In the housing 131*a* are arranged three self-aligning ball or roller bearings 138, 182, 183. A hollow shaft 137 is journalled radially and axially by the two bearings 138 and 182 and carries a pinion 187 engaging a worm wheel 188 driven by a motor. The shaft 143*b* of the coupling piece 143 penetrates through a hollow shaft 137 and is secured rotationally fast to this hollow shaft 137 by a schematically represented key 189. The shaft 143*b* of the coupling piece 143 is provided with a shoulder butting against the lower end face of the hollow shaft 137. A securing member 231, formed, for instance, by a disk is fixed by a screw 232 to the shaft 143*b* and butts against the upper end face of the bearing 183. The coupling piece 143 is thus secured against axial displacements by the said shoulder and the securing member 231. The upper end of the shaft of the coupling piece is furtheron journalled radially by the bearing 183.

Sealing rings 183 and 184 are arranged in the housing 131*a* below the bearing 138 and above the bearing 182, respectively. The gear wheels 187 and 188 are thus arranged in a chamber sealed against the outer space and partially filled with lubricating oil for lubrication of the gear wheels and the lower bearing 138. The two bearings 182, 183 above the level of the lubricating oil, are lubricated with grease. A deriving ring 149, made of natural or synthetic rubber or the like is mounted on the shaft 143 above the pressing member 147 and has a lip butting against the flange of the pressing member 147.

The worm 141 is thus rotationally and axially fast connected with the coupling piece 143 and the hollow shaft 137 and journalled exclusively at its upper end on the outside of the cover 119 and the outside of the sealing rings 181. All the parts needing lubrication, i.e. bearings and gear means, are thus arranged outside the mixing chamber on the upper side of the cover.

The deriving ring 149 additionally seals the leadthrough through the cover. Furtheron it can derive an eventual leaking stream of the lubricant oil away from the shaft 143 by a dotted path 100. The conical shape of the cover 119 and the flange of the pressing member 147 arranged above the sealing rings 181 make it practically impossible that a leaking oil stream can penetrate into the stuffing box and reach the sealing rings 181. There is, therefore, a multiple security against the entrance of lubricant into the vessel 105. At first, the chamber of the housing 131*a* comprising gear wheels and bearings requiring a lubrication is sealed against the surroundings and particularly against the cover 119. But even if some lubricant should leak out of housing 131*a*, this leak stream will be lead away from the shaft 143 by the deriving ring before it reaches the sealing rings 181. Finally the rings 181 are sealing the lead through of the shaft of the coupling piece 143 into the vessel 105.

It is noted that the bearing 183 is not absolutely necessary and can be omitted particularly if the volume of the mixer chamber is relatively small, for instance below 1000 l.

The fact that the worm 141 is detachably fixed to the coupling piece 143 by screws or the like allows an easy separation of the worm 141 from the cover and the gear what may be useful for cleaning or repair works. However, it is pointed out that it also be possible to renounce to the coupling piece 143 and to form the worm and shaft extending to the outside of the cover of a single piece.

The sealing ring 25 between the cover and the vessel may be replaced by a ring of rubber and a ring of Teflon (polytetrafluoroethylene).

Thus, in accordance with a feature of the invention, the interior of the vessel is practically completely available for the goods to be treated, the mixer comprises no means, as gears and bearings, in the interior of the vessel needing lubrication, it is much easier to clean the mixer (a good cleaning of all parts having contact with the treated goods is necessary at least when the mixer is to be used for a different goods), and the worm means of the invention can be journalled with comparatively simple means in a very stable manner and without a loss of space in the interior of the vessel at the cover side end. The stable journalling at the cover also allows the lower end of the worm means free, i.e. without bearing.

While a specific embodiment of the invention has been shown and described in detail to illustrate the application of the principles of the invention, it will be understood that the invention may be embodied otherwise without departing from such principles.

What is claimed is:

1. A worm mixer comprising a substantially conically shaped vessel with a vertical axis defining a chamber for the mixing of materials, a cover mounted on said vessel allowing rotation of said cover and said vessel relative to each other about the vertical axis of said vessel, an elongated worm mounted to said cover at an off center location and extending within said chamber, drive means connected to said worm above said cover for rotating said worm about its axis, said worm having an upper end extending through a leadthrough of said cover sealing means sealing said leadthrough of said cover to said worm, and at least one bearing for rotatably journalling said worm about its axis near an upper end of said worm and outside of said chamber, said bearing being mounted on the outside of said sealing means, said drive means being arranged and connected with said worm on the outside of said sealing means with respect to said chamber, the interior of said vessel being free of any gear motor and bearing serving to drive and journal said worm, said worm being journalled at its upper end exclusively outside said chamber.

2. A worm mixer according to claim 1, wherein said drive means includes a self-contained motor mounted on said cover for rotation therewith, further comprising a reduction gear interconnecting said motor to said worm, and wherein said motor is an electric motor and further comprising a slip ring, mounted at a center of said cover, electrically coupled to said motor.

3. A worm mixer according to claim 1, further comprising seal means for sealing said cover against said vessel.

4. A worm mixer according to claim 1, further comprising a frame, said vessel being rigidly attached to said frame and said cover being rotatable relative to said frame.

5. A worm mixer according to claim 1, wherein the worm comprises a core and at least one rib arranged helicoidally along at least a part of said core and is completely arranged inside the said chamber and rigidly and detachably connected with a member extending through said leadthrough to the outside of said cover.

6. A worm mixer according to claim 1, further comprising a housing rigidly mounted to said cover outside of said vessel, said at least one bearing being arranged in said housing, and wherein said housing defines a sealed space which is above said cover.

7. A worm mixer according to claim 6, wherein said drive means includes gear means in said space for driving said worm.

8. A worm mixer according to claim 7, wherein said worm comprises a core and at least one rib arranged helically along at least a part of said core and is completely arranged inside said chamber and rigidly and detachably connected with a member extending through said leadthrough to the outside of said cover, said member connecting said worm rotationally fast with a shaft of said gear means.

9. A worm mixer according to claim 8, wherein said sealing means for sealing said leadthrough to said worm comprises a stuffing box having a sleeve with a sealing package therein engaged around said worm adjacent said leadthrough and a pressing member connected to said sleeve for pressing said sealing package against said worm.

10. A worm mixer according to claim 9, wherein one of said sleeve and pressing member includes a flange above said leadthrough and below said housing, inclined with respect to said vertical axis for diverting any lubricant from said sealed housing space.

11. A worm mixer according to claim 10, including a deriving ring connected to said shaft of said gear means and having a lip engaged on said flange for diverting any lubricant which might leak from said sealed housing space.

12. A worm mixer according to claim 10, wherein said flange includes a raised ring near an outer periphery thereof having a slot therein at a lower end of said flange for defining a lubricant path for directing any lubricant which might leak from said sealed housing space away from said stuffing box.

13. A worm mixer comprising a substantially conically shaped vessel with a vertical axis defining a chamber for the mixing of materials, a cover mounted on said vessel allowing rotation of said cover and said vessel relative to each other about the vertical axis of said vessel, an elongated worm mounted to said cover at an off center location and extending within said chamber, drive means connected to said worm above said cover for rotating said worm about its axis, said worm having an upper end extending through a leadthrough of said cover sealing means sealing said leadthrough of said cover to said worm, and at least one bearing for rotatably journalling said worm about its axis near an upper end of said worm and outside of said chamber, said bearing means being mounted on the outside of said sealing means, said drive means being arranged and connected with said worm on the outside of said sealing means with respect to said chamber, the interior of said vessel being free of any gear motor and bearing serving to drive and journal said worm, said worm being journalled at its upper end exclusively outside said chamber, said sealing means comprising a stuffing box formed of a sleeve connected to said cover around said leadthrough and around a portion of said worm, a sealing package in said sleeve engaged around said worm and a pressing member connected to said sleeve for pressing said sealing package to force said sealing package against said worm, said pressing member comprising a flange above said sealing package, a deriving ring connected to said worm above said flange having a lip engaged on said flange, said drive means including gear means engaged with said worm above said deriving ring, said at least one bearing being above said deriving ring whereby any lubricant used to lubricate said at least one bearing and gear means which may leak downwardly toward said stuffing box is diverted by said deriving ring and flange.

14. A worm mixer according to claim 13, including a housing defining a sealed space engaged around said gear means and connected to said cover, said at least one bearing being in said housing, at least one lower seal connected between said housing and said worm for sealing said housing space against leakage of any lubricant in said housing space toward said stuffing box, said housing defining a path for leakage of lubricant past said at least one seal, over said deriving ring and flange, and away from said housing.

15. A worm mixer according to claim 14, wherein said flange includes a raised ring near an outer periphery thereof having a slot at a lower end of said flange forming a part of said lubricant path, said flange being axially aligned with said worm axis and inclined with respect to said vertical axis.

* * * * *